US009254503B2

(12) United States Patent
Ward

(10) Patent No.: US 9,254,503 B2
(45) Date of Patent: Feb. 9, 2016

(54) ENAMEL COATED BULLET, METHOD OF MAKING AN ENAMEL COATED BULLET

(71) Applicant: Tyler Ward, Seminole, FL (US)

(72) Inventor: Tyler Ward, Seminole, FL (US)

( * ) Notice: Subject to any disclaimer, the term of this patent is extended or adjusted under 35 U.S.C. 154(b) by 79 days.

(21) Appl. No.: 14/276,344

(22) Filed: May 13, 2014

(65) Prior Publication Data

US 2015/0330756 A1 Nov. 19, 2015

(51) Int. Cl.
*F42B 30/02* (2006.01)
*B05D 1/36* (2006.01)
*F42B 33/00* (2006.01)

(52) U.S. Cl.
CPC . *B05D 1/36* (2013.01); *F42B 30/02* (2013.01); *F42B 33/00* (2013.01)

(58) Field of Classification Search
CPC ..... F42B 12/78; F42B 12/80; F42B 12/82; F42B 30/02; F42B 7/10; F42B 33/14; F42B 33/00; B21K 1/025; B05D 1/36
USPC ..... 102/501, 511, 515; 86/19, 55
See application file for complete search history.

(56) References Cited

U.S. PATENT DOCUMENTS 2,507,665 A * 5/1950 Ford ..... C09D 5/08 542/499
2,919,647 A 1/1960 Dear
3,363,561 A 1/1968 Irons
3,580,178 A * 5/1971 Kopsch ..... F42B 12/82 102/515
4,080,899 A * 3/1978 Luban ..... F42B 7/046 102/458
4,196,670 A 4/1980 Vatsvog
4,454,175 A 6/1984 Martin
5,464,487 A * 11/1995 Bane ..... F42B 12/74 148/400
5,535,495 A * 7/1996 Gutowski ..... B22D 17/00 86/54
5,592,986 A * 1/1997 Auger ..... B22C 9/22 164/133
6,352,600 B1 * 3/2002 Alexander ..... B32B 15/01 148/516
8,561,542 B2 10/2013 Authement, Sr.
2003/0078170 A1 * 4/2003 Brown ..... C10M 111/04 508/115
2007/0095241 A1 5/2007 Rice
2010/0037794 A1 * 2/2010 Authement, Sr. ..... F42B 12/40 102/459

OTHER PUBLICATIONS

Azshooter2013, Cast Boolits thread, p. 1, begun Aug. 21, 2013, 05:34 PM GMT, Comment Nos. 1 and 18, found here: http://castboolits.gunloads.com/showthread.php?210666-10-epoxy-coat-can-it-be-done-lets-find-out.*

(Continued)

*Primary Examiner* — Bret Hayes
(74) *Attorney, Agent, or Firm* — Cherskov Flaynik & Gurda, LLC

(57) ABSTRACT

A method for manufacturing an enamel-coated bullet is described. The method starts with casting a bullet from a metal material and quenching the cast bullet. After the bullet cools, applying a lubricant to the bullet and sizing the bullet to the appropriate caliber and rinsing the bullets in a solvent. Thereafter, applying an enamel coating to the bullets. The coating uses about 1 part by volume lacquer thinner, about 1.5 parts by volume hardener, and about 2.5 parts by volume epoxy paint. The process continues by contacting the bullets with a moving fluid for a sufficient time that they become dry and heating the bullets in an oven at a temperature of between 150 and 250° F. for a time between 20 and 45 minutes. Finally, the process involves applying a lubricant to the coated bullet and resizing the bullet to the appropriate caliber.

14 Claims, 3 Drawing Sheets

(56) References Cited

OTHER PUBLICATIONS

Azshooter2013, Cast Boolits thread, p. 2, begun Aug. 21, 2013, 05:34 PM GMT, Comment Nos. 22 and 23, found by clicking either the single right-facing arrow to teh right of the page numbers on p. 1 or by ckicking on the No. 2.*

Wiederladertv, How to make color coated bullets (MCC) incl. recipe, YouTube, published May 15, 2013, published at https://www [dot] youtube [dot] com/watch?feature=player_profilepage &v=uiFxAPtx4c0.

Ares Puskarska Dielna, http://www [dot] ares-gun [dot] sk/?lang=english.

* cited by examiner

ENAMEL COATED BULLET, METHOD OF MAKING AN ENAMEL COATED BULLET

BACKGROUND OF THE INVENTION

1. Field of the Invention

This invention is directed to an enamel coated bullet that prevents barrel leading and to a method of making an enamel coated bullet.

2. Background of the Invention

Repeated firing of a gun will often lead to barrel fouling. Barrel fouling occurs when the interior of a gun barrel becomes coated with remnants of the bullet material. The material (such as lead) accumulates and eventually covers the rifling grooves, thereby reducing the accuracy of the gun. In extreme cases, fouling prevents the bullet from passing through the barrel. Often, the blockage causes gases to build up behind the bullet, leading to explosion.

Lead is the most popular material from which bullets are made. Lead is relatively soft as compared to other metals. This softness has both beneficial and detrimental aspects. Beneficially, the softness allows a lead bullet to obturate the inside diameter of the barrel upon firing. Bullet obturation prevents the high pressure gases from escaping around the edges of the bullet and confines those gases behind the bullet, thereby ensuring maximum propulsion of the bullet.

Detrimentally, friction between the hardened barrel and the soft lead bullet causes lead to deposit on the inside of the barrel, which results in the aforementioned barrel fouling (also known as "barrel leading," particularly when lead bullets are used).

Barrel leading, or fouling, should be removed so as to avoid excessive deposits. Typically, the more that a gun is fired, the more that fouling will have to be removed. Removing barrel fouling generally involves a solvent and a wire brush. Excessive leading may require soaking the barrel in a solvent for an extended period of time. Cleaning a barrel requires dismantling of the gun, which can be time-consuming and can lead to improper reassembly.

Shooters try to combat barrel leading in a variety of ways. One way is to use a bullet made of a harder alloy. However, harder bullets do not always obturate the barrel, causing the bullet to bounce around the barrel, leaving scraps of material behind. Also, absent bullet obturation, the hot, pressurized gases blow past the bullet, melting the surface layer of the bullet. This too leaves deposits in the barrel.

Another popular way of reducing leading is to place a jacket of a harder material around the outside of the bullet. The most common jacket material is copper. The harder outer jacket expands enough to obturate the barrel, while preventing the soft lead from contacting the hardened barrel. Jacketed ammunition helps to avoid barrel leading, but it is also much more expensive than its unjacketed counterpart. Also, most at-home bullet casters do not have the equipment or machine skills to apply a metal jacket to a bullet.

Therefore, a need exists in the art for an application to a standard lead bullet that allows the bullet to obturate the barrel, thereby preventing leading. The method should be capable of being applied by amateur bullet casters.

SUMMARY OF THE INVENTION

An object of the present invention is to provide a method for coating bullets that overcomes many of the disadvantages of prior art.

Another object of the present invention is to provide an enamel coating for bullets. A feature of the present invention is that the coating is uniform and crack free. An advantage of the present invention is that the coating reduces barrel deposits such as leading. Another advantage of the present invention is that the coating keeps a bullet together on impact, while still allowing the bullet to mushroom or otherwise deform.

A further object of the present invention is to provide a relatively inexpensive alternative to traditional measures of dealing with barrel leading. A feature of the present invention is a bullet coating whereby the coating is made from inexpensive materials, such as enamel paint. An advantage of the present invention is that the enamel coating is less expensive than jacketed rounds.

Still another object of the present invention is to provide a method of applying a color coating to a bullet. A feature of the present invention is the use of epoxy paint in coat applications. An advantage of the invention is that the epoxy paint comes in a variety of colors and finishes. As such, the color coating helps to differentiate between the shots of multiple shooters. Another advantage of the present invention is that the color coating makes the sport of shooting more enjoyable by allowing the practitioner to customize his bullets.

The present invention provides a method for manufacturing an enamel-coated bullet, said method comprising the steps of casting a bullet from a metal material; quenching the cast bullet; applying a lubricant to the bullet; sizing the bullet to the appropriate caliber; rinsing the bullets in a solvent; applying an enamel coating to the bullets, wherein the coating comprises about 1 part by volume lacquer thinner; about 1.5 parts by volume hardener; and about 2.5 parts by volume epoxy paint; contacting the bullets with heated fluid for a sufficient time that they become substantially dry; heating the bullets in an oven at a temperature of between about 150 and about 250° F. for a time between 20 and 45 minutes; applying a lubricant to the coated bullet; and resizing the bullet to the appropriate caliber.

BRIEF DESCRIPTION OF THE DRAWINGS

The invention together with the above and other objects and advantages will be best understood from the following detailed description of the preferred embodiment of the invention shown in the accompanying drawings, wherein.

DETAILED DESCRIPTION OF THE INVENTION

The foregoing summary, as well as the following detailed description of certain embodiments of the present invention, will be better understood when read in conjunction with the appended drawings.

As used herein, a method step recited in the singular and preceded with the word "a" or "an" should be understood as not excluding plural of said steps, unless such exclusion is explicitly stated. Furthermore, the references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The present invention is directed to a method of applying an enamel coating to a bullet. The enamel coating substantially reduces the amount of barrel fouling upon shooting a large number of cartridges.

Figure 1:
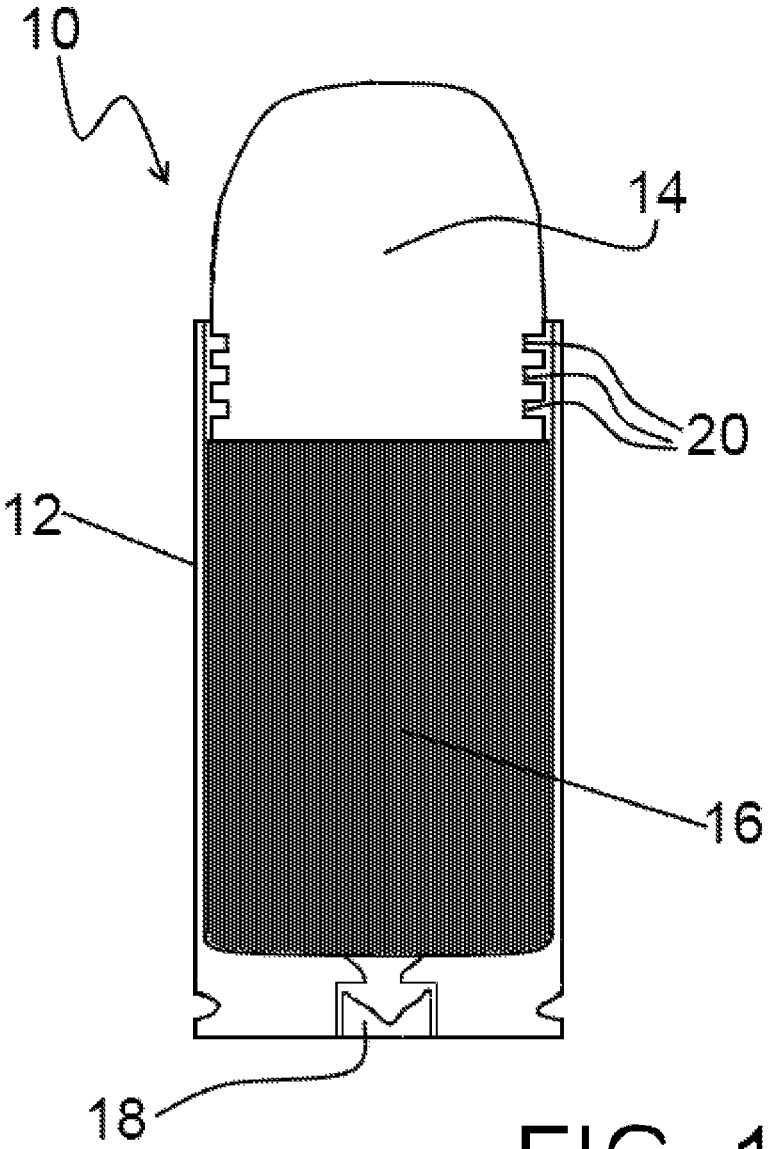
FIG. 1 (prior art)
FIG. 1 is a sectional view of a prior art representative cartridge.
Figure 2:
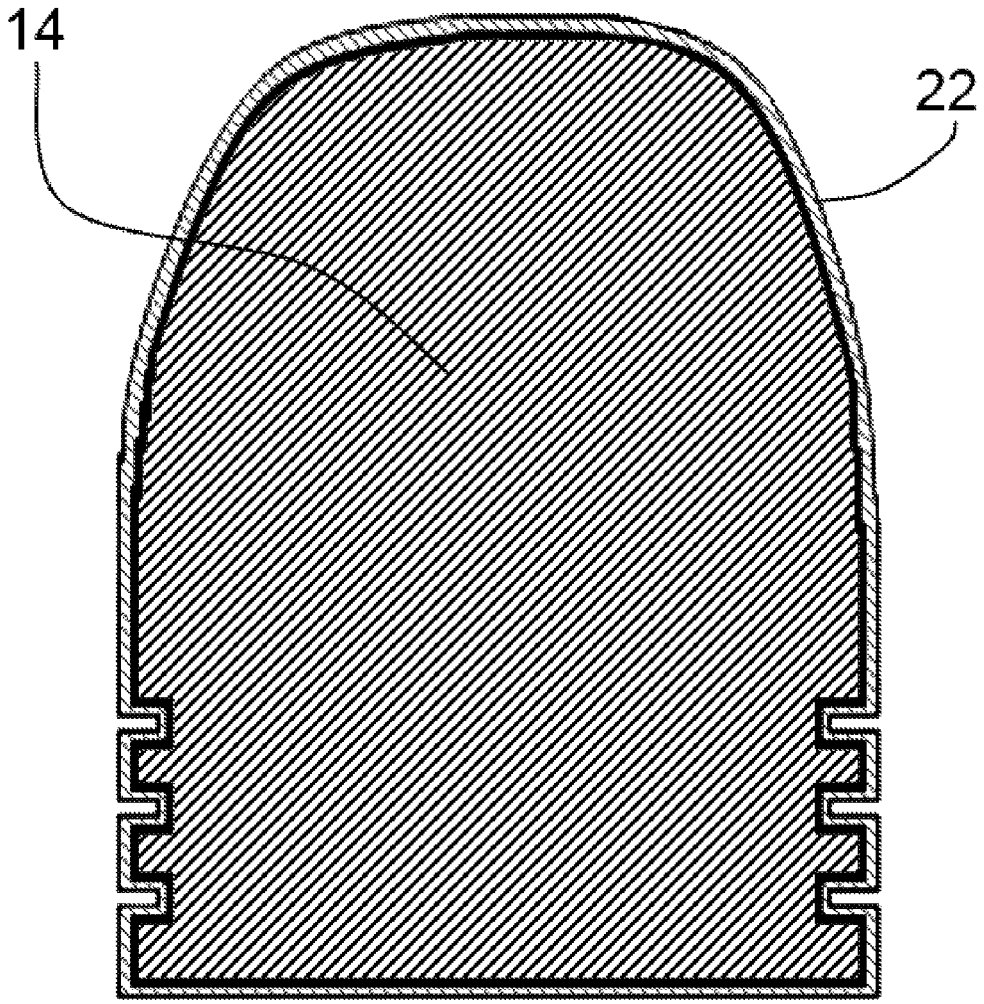
FIG. 2 is a sectional view of the coating on a bullet, in accordance with the features of the present invention.

As can be seen in FIG. 1, a prior art cartridge 10 is primarily comprised of a cylindrically-shaped casing 12, a bullet 14, a propellant 16, and a primer 18. The propellant 16 is typically gun powder. The primer 18 is a small cup of primary explosive that is set off by the firearm's firing pin. This causes an initial explosion that ignites the propellant 16, which propels the bullet 14. The bullet 14 may contain a number of lubrication grooves 20, which help to reduce barrel fouling. The casing 12 holds all of the components together. As can be seen in FIG. 2, the presently invented coating 22 is applied only to the bullet 14 as opposed to the entire cartridge 10.

Bullet Preparation

Detail

Figure 3:
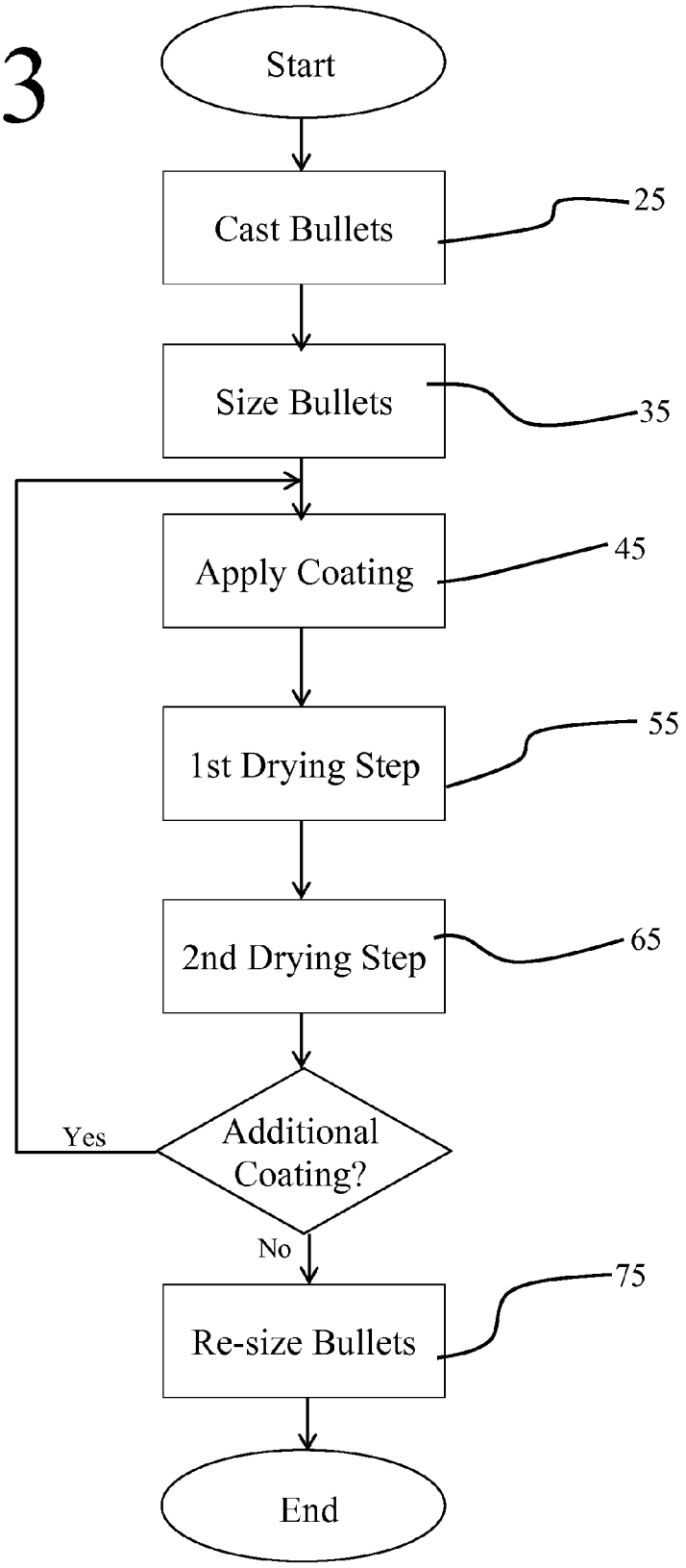
FIG. 3 is a flow chart of a protocol for producing colored bullets, in accordance with features of the present invention.

Preparation of the bullet to receive the coating is an important step to ensure that the coating will be uniform and crack free. If the bullet is not properly prepared, then residue on the bullet could cause the enamel to split or flake off. FIG. 3 is a flowchart of a preferred process for preparing bullets.

Bullets can be cast from a variety of metals. Lead and lead alloys are by far the most popular metals from which to cast bullets. However, other metals are used for special situations. For instance, environmentally friendly, i.e., non-toxic, bullets can be made from steel, bismuth, or tungsten. For other applications, bullets have been made of copper, nickel, tellurium, brass, steel, and even depleted uranium.

In one embodiment of the enamel coating, the formulation and process of application are optimized for use with a hardball formula lead. Generally, hardball lead is comprised of about 2 to 3 weight percent tin, about 6 weight percent antimony, and about 91 to 92 weight percent lead. Hardball lead is commonly used for casting lead bullets, and the following embodiment will be framed in terms of casting hardball lead bullets. Nevertheless, the invented method applies to bullets made from other lead alloys, other metals, or nonmetal substrates. Other lead alloys are presented in Table I, below.

TABLE I

Common Lead Alloys for Casting Bullets

| | weight percentage | | |
|---|---|---|---|
| Alloy | Tin | Antimony | Lead |
| Foundry Type | 10-15 | 20-23 | 62-70 |
| Monotype | 8-9 | 16-19 | 72-76 |
| Stereotype | 6 | 14-16 | 78-80 |
| Linotype | 2-6 | 11-12 | 82-87 |
| Lyman #2 | 5 | 5 | 90 |
| Electrotype | 3 | 2.5 | 94.5 |
| 1:10 Tin-Lead | 9 | — | 91 |
| 1:20 Tin-Lead | 5 | — | 95 |
| 1:30 Tin-Lead | 3 | — | 97 |
| 1:40 Tin-Lead | 2.5 | — | 97.5 |
| Hardball | 2 | 6 | 92 |
| #8 Magnum | — | 2-3 | 97-98 |
| #8 Chilled Shot | 3 | 2-3 | 94-95 |

As can be seen in FIG. 3, the first step of the invented method is the casting step 25. The process of casting bullets begins with melting the bullet material. Hardball lead is completely liquid at approximately 534° F. However, it is recommended to heat the lead to a temperature of about 600° F. to ensure that the lead remains liquid during the casting process. Any burner capable of heating a crucible to bullet melting point temperatures can be used, including electric burners, gas burners, and wood-burning stoves. Suitable crucibles include any non-reactive crucible having a melting temperature above that of lead. Iron crucibles are commonly available and suitable for this purpose. Ceramic crucibles are also suitable.

A means for stirring and transferring the melted bullet material to a die is also required. One such means is a ladle. Iron ladles are particularly suitable. Kits for melting ingots are commercially available such as the Lyman Big Dipper Casting Starter Kit by Lyman Products Corp. (Middletown, Conn.) that provide a heater, crucible, and ladle.

With melting of the lead, a layer of slag forms on top of the liquid metal. Preferably, this layer is skimmed off the top. The liquid metal is then ladled or otherwise inserted into a bullet mold. A handheld bullet mold is typically comprised of a set of tongs and a mold block. Commonly, the tongs and mold block are reversibly attachable such that a variety of mold blocks can be used with the tongs. Such mold blocks and tongs are commercially available from Lyman Products Corp. After the liquid metal is ladled into the bullet mold, a swinging plate on the mold block is utilized to shear or otherwise remove the excess metal from the top of the mold block.

The bullets are allowed to cool for a time of about 5 to about 20 seconds before being ejected from the mold. Preferably, the bullets are cooled for about 10 seconds before being ejected. The bullets are ejected into a quenching bath. A suitable quenching bath is water maintained at from about 0 degrees to about 100° F., and typically at about room temperature (60-75° F.).

The quenched bullets are then lubricated. Suitable lubricants include paraffin wax, beeswax, and paste wax. A small amount of lubricant, approximately one tablespoon for 100 bullets, is placed in a container with the bullets, and the bullets are tossed to apply the coating. Preferably, the cast and lubricated bullets are allowed to set for a period of about 12 to about 24 hours before being subjected to the next step, which is the sizing step 35.

The sizing step 35 involves forcing the bullets through a bullet sizer. A bullet sizer is a press that forces the cast bullet through a die. In doing so, the die ensures that that bullet is the proper caliber for the rifle barrel diameter. A properly sized bullet should be equal to or up to 1 mil over the rifle barrel diameter. Bullets smaller than the barrel diameter might not properly obturate the barrel and are, thus, less accurate.

After sizing, the bullets are rinsed in a solvent. Rinsing removes the lubricant and any other residue contacting the surface of the bullet. An embodiment of the invented process requires a thorough rinsing to ensure a good bond between the enamel coat and the bullet. Generally, nonpolar solvents are suitable, and some polar ones. Exemplary solvents used in the rinsing step include but are not limited to, acetone, ethanol, rubbing alcohol, toluene, methyl ethyl ketone, mineral spirits, and combinations thereof.

The bullets are again allowed to sit for a time sufficient to dry, which will depend on the type of solvent used. The bullets are dried for between about 20 minutes and about two hours, and preferably for about one hour. Drying may be done at room temperature in ambient humidity or in a controlled humidity environment. Drying may also be done at elevated temperature in ambient humidity or in a controlled humidity environment. In an embodiment of the invented method, bullets are heat treated at a temperature from about 160° F. to about 400° F. or for a time sufficient to volatize or otherwise remove substantially all of the solvent. Preferably, the bullets are heat treated at a temperature ranging from about 320° F. to about 400° F. for a time between about 30 minutes and about 60 minutes. Most preferably, the heat treatment occurs at about 360° F. for about 45 minutes. After heat treatment, the bullets are quenched in room temperature water (i.e., water at approximately 68° F. to approximately 77° F.). The bullets are cleaned with a solvent, such as acetone, ethanol, rubbing alcohol, toluene, or mineral spirits, and allowed to dry. Preferably, the bullets are allowed to rest at room temperature in a ventilated area at ambient humidity for about 48 to about 72 hours to allow the lead alloy to harden before applying the enamel coating. In one embodiment of the invented process, this hardening/recovery step allows the treated bullets to reclaim or reestablish much of the hardness that was lost during casting and sizing of the bullets.

Applying the Enamel Coating

The next step of the invented method is the coating step 45. The enamel coating is prepared in a mixing container using approximately 1 part by volume lacquer thinner, approximately 1.5 parts by volume hardener, and approximately 2.5 parts by volume epoxy paint. The inventor has found that Klass Kote epoxy paint and hardener (Diversified Solutions, LLC, Eagen, Minn.) to be suitable for the coating. A suitable lacquer thinner is Klean-Strip® lacquer thinner (W. M. Barr & Co., Inc., Memphis, Tenn.). In another embodiment, the enamel coating further comprises between about 0.5 and about 2 volume percent of a dry lubricant. Preferably the dry lubricant is graphite; however, other suitable dry lubricants, such as hexagonal boron nitride, molybdenum disulfide, tungsten disulfide, synthetic materials, such as a fluorocarbon polymer (including polytetrafluroethylene, i.e., TEFLON®), and combinations thereof.

The enamel coating can be mixed in any suitable container. Preferably, the container has a lid to prevent the enamel from drying prematurely. The bullets are then added to the enamel mixing container. In another embodiment, the enamel coating is poured into the container holding the bullets. The bullets are tossed, tumbled or otherwise homogeneously mixed with the liquid enamel coating until they are evenly coated, which takes approximately four minutes for about 100 bullets if the coating was prepared using tablespoon measurements.

After the bullets are adequately coated, they are placed on a drying rack. Preferably the bullets are immediately transferred from the enamel coating applicator to a substrate comprising a drying rack that is nonreactive to constituents of the enamel coating. Such a rack has a non-stick surface, such as ceramic or TEFLON®, or it is lined with a non-stick barrier, such as a paraffin coated webbing such as wax paper. The bullets are placed in an upright position on the rack for drying. While on the drying rack, the bullets undergo a first drying step 55. The first drying step 55 occurs in circulating fluid that is nonreactive to constituents of the enamel coating. Air is a suitable fluid; although, other gases, such as nitrogen, carbon dioxide, helium, argon, inert gases, and combinations thereof, can be used. The fluid can be at room temperature or it can be heated up to about 140° F. Once the coating is dry to the touch, the drying tray is placed in an oven for a second drying step 65. The bullets are cured in the oven at a temperature of between about 150° F. and about 250° F. for a time between about 20 minutes and about 45 minutes.

The bullets are then removed from the oven. At this point, the bullets can optionally be coated for a second time. However, the coating can be applied three or more times if desired by the practitioner.

After the desired number of coatings is applied to the bullet, a lubricant is applied to the coated bullet, and the bullet is re-sized during resizing step 75. The same lubricant applied in the first sizing step 35 can be applied. Such lubricants included paraffin wax, beeswax, and paste wax, among others. FIG. 2 is a sectional view of the bullet 14 with the applied enamel coating 22. After the bullet is prepared it is ready for loading. Preparation of a cartridge involves seating a primer in a shell casing, loading the propellant into the casing, and pressing the bullet into the casing. The inventor has not noticed that loading the bullet into the casing causes any of the coating to be removed.

Thus, the present invention provides a method of applying an enamel coating to a bullet. The coating provides a relatively inexpensive and reliable solution to the problem of barrel leading, or fouling. The coating allows the practitioner to customize the color of the bullets, which is useful for differentiating the shots of multiple shooters apart on target imprints. For example, if two hunters were to shoot at the same game, then any dispute about whose bullet struck the game could be resolved on the basis of the color of the bullet removed from the game.

The coating also helps to keep the bullet together on impact, while still allowing the bullet to mushroom. Further, while the present discussion has been framed in terms of at-home bullet casters, the presently invented method can easily be scaled to an industrial setting.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. §112(f) unless and until such claim limitations expressly use the phrase "means for" followed by a statement of function void of further structure.

The present methods can involve any or all of the steps or conditions discussed above in various combinations, as desired. Accordingly, it will be readily apparent to the skilled artisan that in some of the disclosed methods certain steps can be deleted or additional steps performed without affecting the viability of the methods.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The method in which an exclusive patent right or privilege is claimed is described as follow:

1. A method for manufacturing an enamel-coated bullet, said method comprising the steps of:

a. casting a bullet from a metal material;
b. quenching the cast bullet;
c. applying a lubricant to the bullet;
d. sizing the bullet to the appropriate caliber;
e. rinsing the bullet in a solvent;
f. applying an enamel coating to the bullet, said coating comprising:
  i. about 1 part by volume lacquer thinner;
  ii. about 1.5 parts by volume hardener; and
  iii. about 2.5 parts by volume epoxy paint;
g. contacting the bullet with a moving fluid for a sufficient time that the bullet becomes substantially dry;
h. heating the bullet in an oven at a temperature of between about 150 and about 250° F. for a time between 20 and 45 minutes;
i. applying a lubricant to the coated bullet; and
j. resizing the bullet to the appropriate caliber; wherein the coating further comprises between about 0.5 and about 2 volume percent of a dry lubricant.

2. The method of claim 1, wherein steps f through h, inclusive, are repeated before proceeding to step i.

3. The method of claim 1, wherein the lubricant of steps c and i is paste wax.

4. The method of claim 1, wherein the enamel coated bullet is supported by a substrate before the application of hot fluid, wherein the substrate is nonreactive to constituents of the enamel coating.

5. The method of claim 4, wherein the substrate comprises a non-stick surface which defines transverse pores adapted to allow passage of fluid.

6. The method of claim 1, wherein the metal material is selected from the group consisting of lead and lead alloys.

7. The method of claim 6, wherein the lead alloy is comprised of about 2 weight percent tin, about 6 weight percent antimony, and about 92 weight percent lead.

8. The method as recited in claim 1 wherein the fluid is nonreactive to constituents of the enamel coating.

9. The method as recited in claim 1 wherein the fluid is selected from the group consisting of air, argon, nitrogen, carbon dioxide, and combinations thereof.

10. An enamel coated bullet made according to the method of claim 1.

11. A method for manufacturing an enamel-coated bullet, said method comprising the steps of:

a. casting a bullet from a metal material;
b. quenching the cast bullet;
c. applying a lubricant to the bullet;
d. sizing the bullet to the appropriate caliber;
e. rinsing the bullet in a solvent;
f. applying an enamel coating to the bullet, said coating comprising:
  i. about 1 part by volume lacquer thinner;
  ii. about 1.5 parts by volume hardener; and
  iii. about 2.5 parts by volume epoxy paint;
g. contacting the bullet with a moving fluid for a sufficient time that the bullet becomes substantially dry;
h. heating the bullet in an oven at a temperature of between about 150 and about 250° F. for a time between 20 and 45 minutes;
i. applying a lubricant to the coated bullet; and
j. resizing the bullet to the appropriate caliber wherein the coating further comprises between about 0.5 and about 2 volume percent of a dry lubricant; and wherein the dry lubricant is graphite.

12. A method for manufacturing an enamel-coated bullet, said method comprising the steps of:

a. casting a bullet from a metal material;
b. quenching the cast bullet;
c. applying a lubricant to the bullet;
d. sizing the bullet to the appropriate caliber;
e. rinsing the bullet in a solvent;
f. heat treating the bullet at a temperature between 320° F. and 400° F. for a time of between 30 minutes and 60 minutes;
g. applying an enamel coating to the bullet, said coating comprising:
  i. about 1 part by volume lacquer thinner;
  ii. about 1.5 parts by volume hardener; and
  iii. about 2.5 parts by volume epoxy paint;
h. contacting the bullet with a moving fluid for a sufficient time that they become substantially dry;
i. heating the bullet in an oven at a temperature of between about 150 and about 250° F. for a time between 20 and 45 minutes;
j. applying a lubricant to the coated bullet; and
k. resizing the bullet to the appropriate caliber.

13. The method as recited in claim 12, wherein the bullet is rinsed in a solvent after heat treating.

14. The method as recited in claim 13, wherein the bullet is allowed to harden for at least about 48 hours after being rinsed in a solvent.

* * * * *